US005316067A

United States Patent [19]

LeClaire

[11] Patent Number: 5,316,067

[45] Date of Patent: May 31, 1994

[54] SWAG SUPPORT

[75] Inventor: John W. LeClaire, Middleton, Wis.

[73] Assignee: Springs Window Fashions Division, Inc., Madison, Wis.

[21] Appl. No.: 81,137

[22] Filed: Jun. 25, 1993

Related U.S. Application Data

[63] Continuation-in-part of Ser. No. 983,379, Nov. 30, 1992.

[51] Int. Cl.[5] ..... A47H 13/14

[52] U.S. Cl. ..... 160/348; 160/330; 160/349.2

[58] Field of Search ..... 160/348, 349.1, 349.2, 160/330, 38; 16/108, 94 D, 87.2; 248/262, 261

[56] References Cited

U.S. PATENT DOCUMENTS

| | | | |
|---|---|---|---|
| 2,236,017 | 3/1941 | Stratton . | |
| 2,244,129 | 6/1941 | Stratton . | |
| 2,409,425 | 10/1946 | Falkenberg | 160/348 |
| 2,606,733 | 8/1952 | Krajewski . | |
| 3,022,819 | 2/1962 | Lampret | 160/345 |
| 3,119,442 | 1/1964 | Ford et al. | 160/345 |
| 3,203,469 | 8/1965 | Falkenberg . | |
| 3,370,819 | 2/1968 | Kenny | 160/345 X |
| 3,402,421 | 9/1968 | Weber | 16/94 D |
| 3,545,523 | 12/1970 | Falkenberg | 160/348 |
| 3,901,303 | 8/1975 | Falkenberg . | |
| 4,417,807 | 12/1968 | Falkenberg . | |
| 5,146,972 | 9/1992 | Tacchella | 160/349.2 X |

*Primary Examiner*—Blair M. Johnson
*Attorney, Agent, or Firm*—Vernon J. Pillote

[57] ABSTRACT

A swag holder including a unitary body having a generally C-shaped front portion and an upper rear portion extending downwardly at a rear side of the front portion and a lower rear portion extending upwardly at a rear side of the front portion and a head on the upper rear portion for mounting the body on a curtain rod. The holder is supported on a wall mounting bracket including a generally horizontal bracket member and an upwardly opening U-shaped saddle on a forward end of the bracket member for receiving the head on the upper rear portion of the body. The saddle supports the swag holder body with the bracket member at a level above the lower end of the upper rear portion and with the upper end of the lower rear portion spaced below the saddle.

10 Claims, 1 Drawing Sheet

SWAG SUPPORT

CROSS-REFERENCE TO RELATED APPLICATIONS

This application is a continuation-in-part of the application of Angelo M. Marasco, John W. LeClaire and James A. Raisbeck, Ser. No. 07/983,379, filed Nov. 30, 1992 for "Swag Support".

BACKGROUND OF THE INVENTION

Various different swag support systems have heretofore been made for supporting a fabric swag or festoon over a window opening. Some such as disclosed in U.S. Pat. Nos. 2,236,017 and 2,244,129 mount festoon rings on a curtain rod or on the curtain rod brackets at the end of the rod. In U.S. Pat. No. 2,606,733, upwardly opening U-shaped swag support brackets are mounted at the front side of a curtain rod. U. S. Pat. Nos. 3,203,469; 3,417,807 and 3,901,303 disclose swag holders that are mounted by independent brackets and arranged so that the swag hangs in front of the curtain rod to conceal the rod. In swag supports using ring-type swag holders, it is necessary to insert an end portion of the fabric through each ring and some difficulties are encountered in forming the desired fold or configuration in the rings while equalizing the length of the side drops of the swag and forming the desired curve or drape between the rings. The swag holders in U.S. Pat. Nos. 3,203,469; 3,417,807 and 3,901,303 provide fingers in the rear side of the holders to form slots for receiving folds in the fabric to facilitate pleat formation.

SUMMARY OF THE INVENTION

The application identified above discloses a swag support system in which the swag holders are mounted on a curtain rod. Each swag holder comprises a unitary body having a generally C-shape front portion, an upper rear portion extending downwardly at a rear side of the front portion with head means on the upper rear portion for mounting the swag holder on the curtain rod. The prior swag holder also had a fabric clip extending downwardly at a rear side of the upper rear portion for holding an upper portion of a fabric swag scarf.

Various objects of the present invention are to provide a wall mounting bracket which is arranged to mount the prior rod mounted type of swag holders directly on a wall; which does not interfere with installation of a fabric swag on the swag holders; which does not require use of tools to mount the swag holder on the bracket and which mounting bracket is not visible from the front of the swag holder.

Accordingly, the present invention provides a wall mounting bracket including a generally horizontal bracket member and an upwardly opening U-shaped saddle at a forward end of the bracket member for receiving the rod mounting head means on the upper rear portion of the swag holder body. The saddle supports the body with the bracket member at a level above the lower end of the upper rear portion of the body and with the upper end of the lower rear portion spaced below the saddle to allow installation of a fabric swag into the holder from the rear side of the latter.

The bracket member has an opening rearwardly of the saddle for passage of the lower end of the fabric clip therethrough and means are advantageously provided for clamping a fabric piece at a rear side of the saddle.

DESCRIPTION OF THE PREFERRED EMBODIMENT

Figure 1:
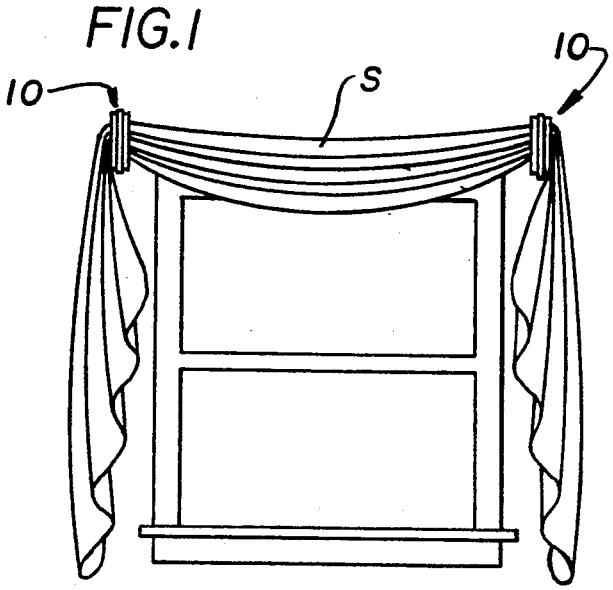
FIG. 1 is a front elevational view illustrating the use of the swag support of the present invention supporting a fabric swag over a window opening.

The swag holders 10 comprise a unitary body having a generally C-shaped front portion 11, an upper rear portion 12 extending downwardly at a rear side of the front portion and a lower rear portion 13 extending upwardly at a rear side of the front portion. A lower end of the upper rear portion and an upper end of the lower rear portion are spaced apart to allow insertion of a fabric swag into the C-shaped front portion from the rear side of the body. The swag holder is of the type which is adapted for mounting on a curtain rod and the upper rear portion of the body has a head 14 at a lower end thereof with upper and lower grooves for reception in a slotted curtain rod. In the embodiment disclosed in the prior application, the swag holder body also includes a fabric clip 16 that extends downwardly at a rear side of the upper rear portion 12 for receiving an upper portion of a fabric swag.

Figure 4:
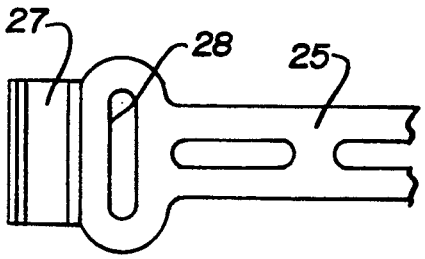
FIG. 4 is a fragmentary top view of the bracket for mounting the swag holder on a wall.
Figure 3:
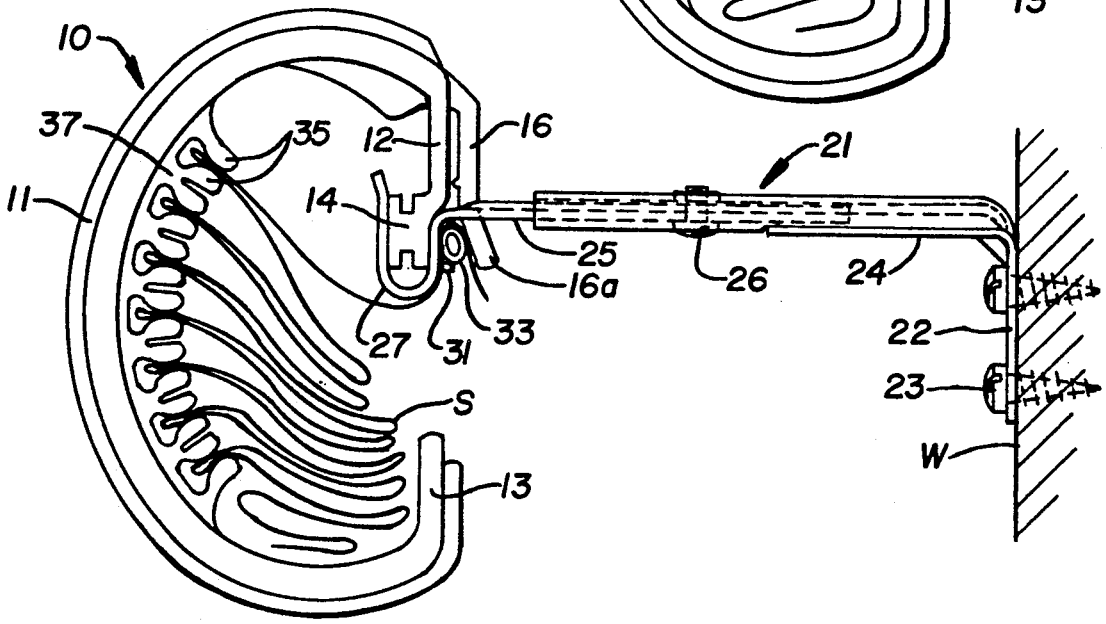
FIG. 3 is a side elevational view of a swag holder and mounting bracket illustrating a fabric scarf assembled in the swag holder.

In accordance with the present invention, a wall mounting bracket 21 is provided for mounting the swag holder body on a wall or window casing W. The bracket 21 is preferably adjustable to enable adjustment of the spacing of the swag holders from the wall and, as best shown in FIGS. 3 and 4, the bracket includes a generally L-shaped member having a wall engaging pad portion 22 adapted to be attached to the wall by fasteners 23 and a horizontally extending leg 24. A generally horizontal bracket member 25 is adjustably mounted on the horizontal leg of the wall engaging bracket and means such as a fastener 26 is provided for securing the bracket member 25 in adjusted position. The bracket member has an upwardly opening U-shaped saddle 27 on the forward end arranged to receive the head 14 on the lower end of the upper rear portion of the swag holder body. The saddle supports the swag holder body with the bracket member 25 at a level above the lower end of the upper rear portion and with the upper end of the lower rear portion spaced below the saddle so that the bracket does not interfere with installation of the fabric swag into the swag holder from the rear side.

Figure 2:
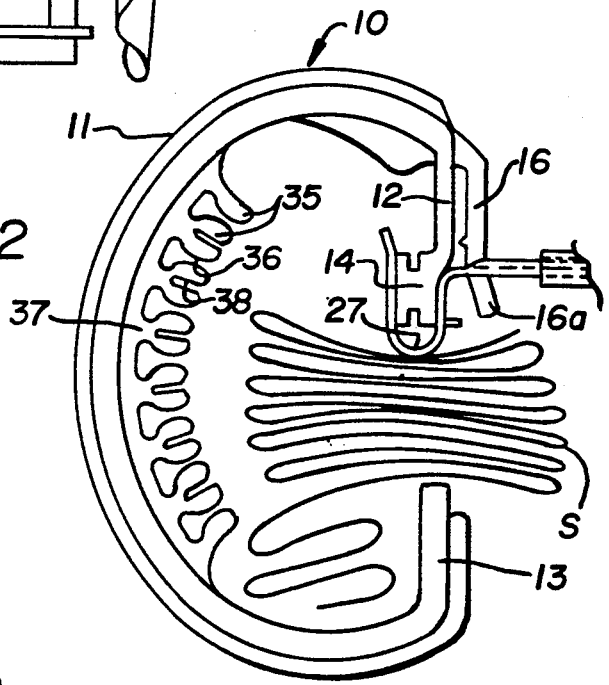
FIG. 2 is a side view of the swag holder illustrating loading of a fabric swag into the swag holder.

The fabric clip 16 extends downwardly to a level adjacent the head 14 and the bracket member 25 has an opening 28 rearwardly of the saddle 27 for receiving the lower end portion of the fabric clip. As shown in FIGS. 2 and 3, the lower end portion **16*a* of the fabric clip diverges rearwardly from the head portion and, when mounting the swag holder body on the bracket, the lower end 16*a* of the fabric clip is inserted into the opening and the swag holder body is thereafter tilted downwardly, in a counter-clockwise direction as viewed in FIGS. 2 and 3, until the head 14 moves into the saddle 27. Insertion of the lower end of the fabric clip into the opening in the saddle prevents movement of the head 14** horizontally relative to the bracket and the rearwardly diverging angle on the lower end portion of the fabric clip cooperates with the bracket to inhibit upward movement of the swag holder body relative to the bracket.

Provision is made for clamping a portion of a fabric swag at the rear side of the saddle. For this purpose, a tab 31 is formed on the rear side of the saddle portion and extends rearwardly toward the lower end 16*a* of the fabric clip to restrict the space therebetween. As best shown in FIG. 3, a member 33 which is preferably resiliently compressible and of a size which can be inserted between the tab and the lower end of the fabric clip, is provided for clamping a piece of the fabric swag at the rear side of the saddle. The member may, for example, comprise a piece of resilient plastic tube.

As more fully disclosed in the parent application, a plurality of fingers 35 are provided on the inner side of the C-shaped portion of the holder to define a plurality of fold receiving slots 36 at spaced locations therealong. In the preferred embodiment illustrated, each swag holder has a thin web portion 37 extending inwardly along the inner side of the arcuate front portion and the fabric fold receiving slots 36 are formed by reentrant notches in the web with the portions of the web between the notches defining inwardly extending fingers. The notches 32 are preferably formed with enlarged inner ends and flared outer ends as shown in FIGS. 2 and 3 and slots 38 are provided in the web between adjacent notches and extend to a depth adjacent the enlarged inner portions of the notches so that the fingers 35 are resiliently bendable in a direction laterally of the notches.

From the foregoing it is believed that the construction and method of using the swag support will be readily understood. The swag holder body has head means for mounting the body on a curtain rod and the wall mounting bracket is constructed and arranged to mount the swag holder body on a wall so that the same swag holder body can be either rod mounted or wall mounted as desired. In installation, the wall mounting brackets are first mounted on the wall as by fasteners 23 at appropriate locations such as adjacent opposite sides of the window as shown in FIG. 1, it being apparent that additional swag holders can be provided at intermediate locations on wide or multiple windows. The swag holder bodies can then be installed on the wall brackets without the use of tools by inserting the lower end of the fabric clip in the openings 28*a* in the bracket member and then tilting the body in a counterclockwise direction as viewed in FIGS. 2 and 3 to press the head 14 into the saddle. This provides a firm support for the swag holder body on the bracket and prevents dislodgement of the swag holder body from the bracket. The saddle on the bracket supports the swag holder body with the bracket member at a level above the lower end of the upper rear portion and with the upper end of the lower rear portion spaced below the saddle to allow installation of a folded fabric swag S into the swag holder from the rear side of the holder. The pleats in the fabric swag S can be inserted into the fabric receiving notches 36 on the rear side of the C-shaped front portion of the holder.

The embodiments of the invention in which an exclusive property or privilege is claimed are defined as follows:

1. In a swag holder including a unitary body having a generally C-shaped front portion and an upper rear portion extending downwardly at a rear side of the front portion and a lower rear portion extending upwardly at a rear side of the front portion, a lower end of the upper rear portion and an upper end of the lower rear portion being spaced apart for installation of a fabric swag into the C-shaped front portion from the rear side of the body, the upper rear portion including head means for mounting the body on a curtain rod, the combination with said swag holder of wall mounting bracket means including a generally horizontal bracket member, and an upwardly opening U-shaped saddle means on a forward end of the bracket member for receiving the head means on the upper rear portion of the body, the saddle means supporting the body with the bracket member at a level above the lower end of the upper rear portion and with the upper end of the lower rear portion spaced below the saddle means, the head means for mounting the body on a curtain rod including grooves for reception in a slotted curtain rod.

2. A swag holder according to claim 1 wherein the body includes a fabric clip extending downwardly at a rear side of the upper rear portion, the bracket member having an opening rearwardly of the saddle means for passage of a lower end of the fabric clip therethrough.

3. In a swag holder including a unitary body having a generally C-shaped front portion and an upper rear portion extending downwardly at a rear side of the front portion and a lower rear portion extending upwardly at a rear side of the front portion, a lower end of the upper rear portion and an upper end of the lower rear portion being spaced apart for installation of a fabric swag into the C-shaped front portion from the rear side of the body, the upper rear portion including head means for mounting the body on a curtain rod, the combination with said swag holder of wall mounting bracket means including a generally horizontal bracket member, and an upwardly opening U-shaped saddle means on a forward end of the bracket member for receiving the head means on the upper rear portion of the body, the saddle means supporting the body with the bracket member at a level above the lower end of the upper rear portion and with the upper end of the lower rear portion spaced below the saddle means, the body including a fabric clip extending downwardly at a rear side of the upper rear portion, the bracket member having an opening rearwardly of the saddle means for passage of a lower end of the fabric clip therethrough.

4. A swag holder according to claim 3 including means for clamping fabric piece at a rear side of the saddle means.

5. A swag holder according to claim 4 wherein said clamping means includes a tab extending rearwardly from the saddle means at a location spaced below the bracket member.

6. A swag holder according to claim 5 wherein said clamping means includes a compressible member insertable above the tab between the saddle means and a lower end of the fabric clip.

7. In a swag holder including a unitary body having a generally C-shaped front portion, an upper rear portion extending downwardly at a rear side of the front portion and a lower rear portion extending upwardly at a rear side of the front portion, the upper rear portion including head means having grooves for reception in a slotted curtain rod, and a fabric clip extending downwardly at a rear side of the upper rear portion, the combination with said swag holder of wall mounting bracket means including a generally horizontal bracket member, and an upwardly opening U-shaped saddle means on a forward end of the bracket member for receiving the head means on a lower end of the upper rear portion, the bracket member having an opening rearwardly of the saddle means for passage of a lower end of the fabric clip therethrough, the saddle means supporting the body with the bracket member at a level above the lower end of the upper rear portion and with an upper end of the lower rear portion spaced below the saddle means, and means for clamping a portion of a fabric swag at a rear side of the saddle means.

8. A swag holder according to claim 7 wherein said clamping means includes a tab extending rearwardly from the saddle means at a location below the bracket member.

9. A swag holder according to claim 8 wherein said clamping means includes a compressible member insertable above the tab between the saddle means and the lower end of the fabric clip.

10. A swag support according to claim 7 wherein the swag holder includes a plurality of fingers on an inner side of the C-shaped front portion defining a plurality of fabric fold receiving slots at spaced locations along the C-shaped portion.

* * * * *